US005679066A

United States Patent [19]

Butz et al.

[11] Patent Number: 5,679,066

[45] Date of Patent: Oct. 21, 1997

[54] ECCENTRIC DISK GRINDER WITH A GRINDING DISK BRAKE

[75] Inventors: Dieter Butz, Kirchheim; Mario Frank, Buehl; Guenther Berger, Notzingen; Stefan Heess, Filderstadt; Juergen Stierle, Stuttgart, all of Germany

[73] Assignee: Robert Bosch GmbH, Stuttgart, Germany

[21] Appl. No.: 640,493

[22] Filed: May 1, 1996

Related U.S. Application Data

[63] Continuation of Ser. No. 120,574, Sep. 10, 1993, abandoned.

[30] Foreign Application Priority Data

Jul. 10, 1992 [DE] Germany ..... 42 33 729.1

[51] Int. Cl.[6] ..... B24B 23/00

[52] U.S. Cl. ..... 451/357; 451/359; 451/344

[58] Field of Search ..... 451/356, 357, 451/358, 359, 344

[56] References Cited

U.S. PATENT DOCUMENTS 3,934,657 1/1976 Danielson .
5,261,190 11/1993 Berger et al. .
5,317,838 6/1994 Bourner .

FOREIGN PATENT DOCUMENTS 320599 6/1989 European Pat. Off. .

*Primary Examiner*—Eileen Morgan
*Attorney, Agent, or Firm*—Michael J. Striker

[57] ABSTRACT

An eccentric disk grinder has a grinding disk, an eccentric shaft fixedly connected with the grinding disk, a motor, a shaft having an axis arranged so that the motor eccentrically, circulatingly and rotatably moves around the axis of the shaft, with the eccentric shaft being rotatable relative to the shaft, a braking device provided for delaying movement of the grinding disk and having a braking element which follows the movement of the grinding disk and is delayable relative to the grinding disk.

51 Claims, 6 Drawing Sheets

Fig. 11
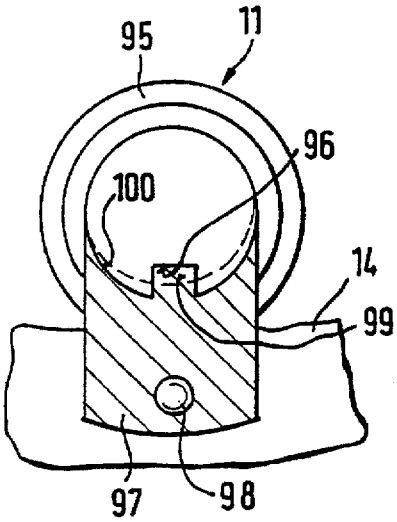
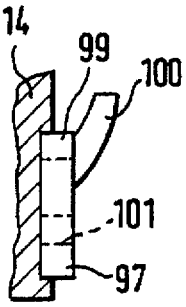
Fig. 12
Fig. 13
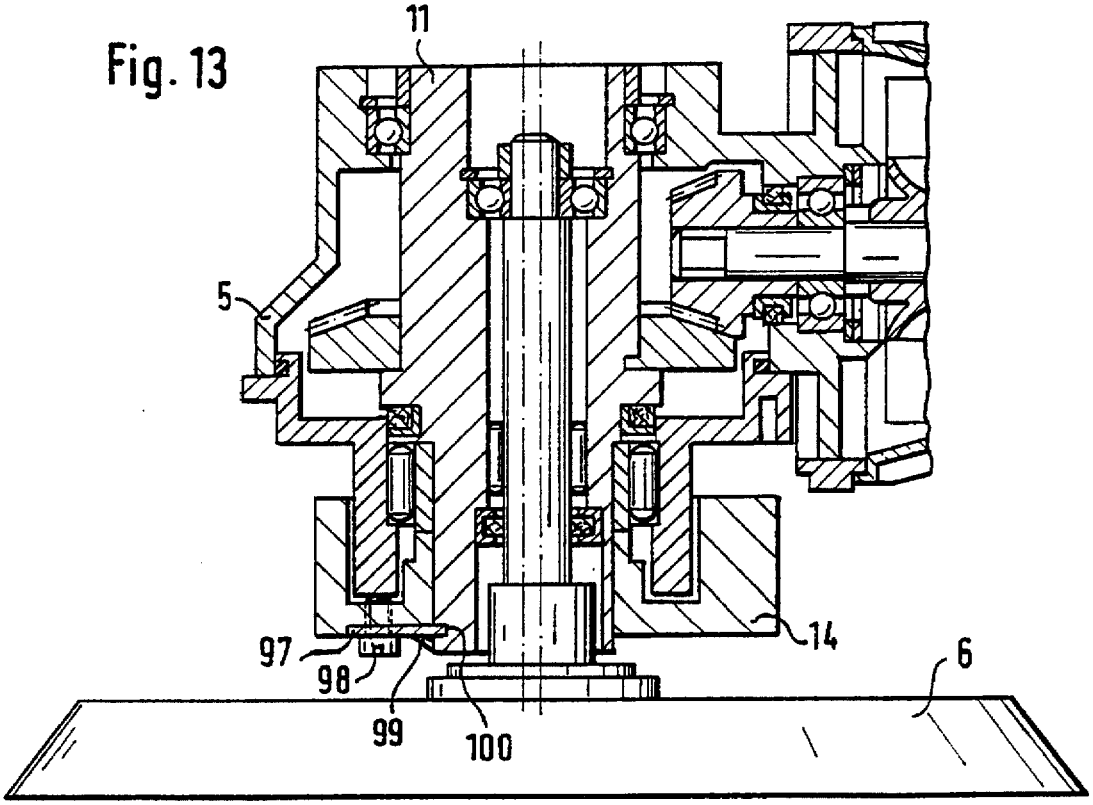

ECCENTRIC DISK GRINDER WITH A GRINDING DISK BRAKE

This is a continuation of application Ser. No. 08/120,574 filed Sep. 10, 1993 now abandoned.

BACKGROUND OF THE INVENTION

The present invention relates to an eccentric disk grinder with a grinding disk brake.

More particularly, it relates to an eccentric disk grinder which has a motor housing accommodating a motor with an eccentric shaft connected with a grinding disk and a braking device which delays the movement of the grinding disk.

Eccentric disk grinders of the above-mentioned general type are known in the art. One of such eccentric disk grinders is disclosed for example in the European patent document EP-PS 320,599. Rotation of the motor is converted via an angular transmission to a shaft which carries an eccentric pin into the working movement of the grinding disk. The working movement is .composed of a rotary movement and a circulatory movement of the grinding disk and is performed in the following manner. The twice-supported shaft carries at its free end an eccentric pin. The eccentric pin has an eccentricity "e" to the shaft axis. It carries concentrically to its axis an eccentric shaft supported in two roller bearings. The eccentric shaft is coupled for joint rotation with the grinding disk. When the shaft rotates, the eccentric pin also performs a rotary and circulating movement together with the eccentric shaft and the grinding disk with the eccentricity "e" around the axis of the shaft. The grinding disk and the eccentric shaft rotate due to the bearing friction of the eccentric pins with the shaft. When a braking moment is applied to the grinding disk or the eccentric shaft which is greater than the torque due to the bearing friction, the grinding disk and the eccentric shaft perform a circulatory movement without the rotation.

The grinding disk must rotate only When a relatively high material removal is provided. The rotation is undesirable when the driven grinding disk does not contact the workpiece, when in other words there is no braking moment and the rotary speed of the grinding disk can increase uncontrollably or when the eccentric disk grinder must be utilized as a swinging grinder with minimal removal power. This results in the so-called high-rotation-effect which is limited in the known eccentric disk grinders by a magnetic brake. The magnetic brake is mounted easily and simply; however, it requires accurate adjustments. It must be dust-tight, since additional friction losses can lead to some heating and power reduction of the eccentric grinding disk or destruction of the brake. The magnetic brake also cannot be switched off.

In the known eccentric disk grinders in which the motor axis is arranged angularly to the grinding disk axis, a relatively great distance between the grinding disk's lower side and the handle is provided due to the conventional eccentric transmission. Thereby during handling of the eccentric disk grinder a relatively high torque acts around the handle axis, and the operator must compensate it with high force application.

Moreover, in the known eccentric disk grinders, the actuating means for adjusting the operating stage are arranged near the grinding disk but far from the handle. For displacing the actuating means the operator must look away from the workpiece and toward the eccentric grinding disk in order to find the actuating means and remove a hand from the handle to switch the actuating means from one position to another. This is complicated, disturbs the operation, and can easily lead to operational failures.

Moreover, rotary buttons are provided for adjusting the operating depth. In order to rotate the rotary buttons, the operator must simultaneously use at least two fingers of his hand. Furthermore, in the known eccentric disk grinders with mechanical high rotation brakes, the brake surfaces substantially wear out due to the eccentric sliding movement. Because of non-uniform braking forces this leads to the non-quiet running of the disk grinder.

Finally, in the known eccentric disk grinders, the adjustment of the tooth-gaps of the angular transmission is relatively complicated.

SUMMARY OF THE INVENTION

Accordingly, it is an object of the present invention to provide an eccentric disk grinder which avoids the disadvantages of the prior art.

In keeping with these objects and with others which will become apparent hereinafter, one feature of the present invention resides, briefly stated, in an eccentric disk grinder in which the braking device is a braking member which follows the movement of the grinding disk, is delayable relative to the grinding disk, and is formed for example as a disk.

When the eccentric disk grinder is designed in accordance with the present invention, it has a simple, robust mechanical friction brake with an exactly defined, constant braking force for preventing the high rotation effect without an eccentric sliding movement of the braking surfaces, and which is switchable off and controllable from the side of the eccentric disk grinder which faces away from the grinding disk.

Only small operator tilting or rotary moments act on the handle, since the distance between the handle axis and the grinding disk's lower side is small due to the new compact eccentric transmission. Moreover, the operation of steps can be switched over during the operation from above with a single finger, without removing the hand from the handle and without shifting one's sight from the workpiece. The toothed wheels which determine the operational steps have an especially advantageous tooth geometry which facilitates the engagement and disengagement of the toothings during switching over.

Moreover, the tooth play at the angular transmission can be adjusted from the side of the angular transmission housing which faces away from the grinding disk, with low mounting expenses and without the dismounting of the oil-filled region of the angular transmission. Also the mounting of the compensating weights for imbalance compensation of the eccentric movements of the grinding disk is especially simple and reliable.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 11–13 are views showing details of an arrangement for mass compensation of the inventive eccentric disk grinder of FIG. 1.

DESCRIPTION OF PREFERRED EMBODIMENTS

Figure 1:
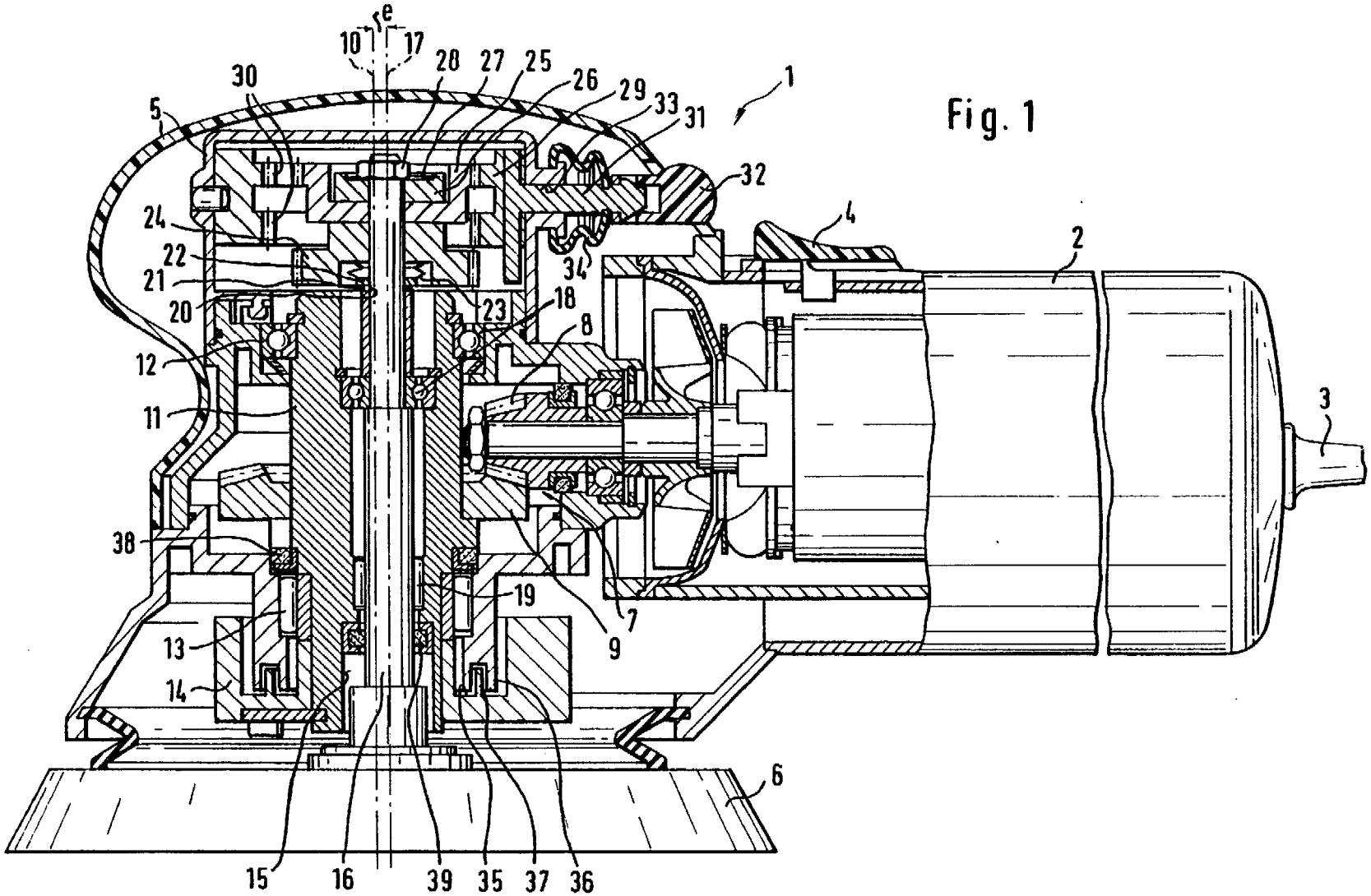
FIG. 1 is a view showing a section of an eccentric disk grinder in accordance with the present invention.

An eccentric disk grinder as shown in FIG. 1 is identified with reference numeral 1 and has a motor housing 2 with an electric connecting cable 3 and an on-off switch 4. An angular transmission housing 5 is mounted on the motor housing 2 and accommodates an angular transmission 7 cooperating with a grinding disk 6. The angular transmission 7 includes a small bevel gear 8 arranged on a not-shown motor shaft and transmitting a motor movement to a large bevel gear 9. The bevel gear 9 surrounds concentrically and engages a shaft 11 which rotates about a rotary axis 10 and is formed as a hollow shaft. The shaft 11 is supported in the angular transmission housing 5 in a bearing 12 which faces away from the grinding disk and a bearing 13 which faces toward the grinding disk.

The shaft 11 carries at its lower free end a compensating weight 14 for compensation of the imbalance produced during the eccentric movement of the grinding disk 6. The shaft 11 has a stepped through-going opening 15 which is eccentric to the rotary axis 10. An eccentric shaft 16 with a longitudinal axis 17 is seated in the opening 15. It rotates parallel to the rotary axis 10 at a distance with the eccentricity "e". The eccentric shaft 16 is guided at a side facing away from the grinding disk in a bearing 18 which is formed as a fixed bearing. At the side facing toward the grinding disk it is guided in a bearing 19 which is formed as a sealed needle bearing taking up radial forces and provided with a not-shown cover sleeve. The eccentric shaft 16 carries the grinding disk 6 at its lower end.

In a recess 20 provided at the side facing away from the grinding disk 6, the eccentric shaft 16 has a spring ring 21. Several co-axially successively arranged elements are further provided and include a supporting ring 22, a lower disk spring 23, a spur gear 24, a ring disk 25 with a not-shown end toothing, a counter disk 26, an upper free-tensioned disk spring 27, and finally a nut 28 which is screwed on as an axial securing element.

The nut 28 can be replaced for example by a further spring ring, the disk spring 23 can be replaced by a spiral pressure spring, and the disk spring 27 can be dispensed with.

The spur gear 24 and the counter disk 26 are arranged axially displaceably on the eccentric shaft 16 for joint rotation with it. The ring disk 25 is rotatable relative to the eccentric shaft 16. It is supported brakingly between the spur gear 24 and the counter disk 26. The spur gear 24 has a smaller number of teeth than the ring disk 25.

A hollow toothed gear 29 with two identical axially spaced toothings 30 is arranged concentrically to the axis 10. The toothings 30 are arranged so that their partial circles contact the not-shown toothings of the spur gear 24 and the ring disk 25. The axial distance between two toothings 30 is smaller than the distance between the spur gear 24 and the ring disk 25. Thereby either the spur gear 24 or the ring disk 25 engage in and roll on one of the toothings 30.

The hollow toothed gear 29 is arranged axially displaceably, so that it can be disengaged from the spur gear 24 or the ring disk 25. A pin 31 which is connected with the hollow toothed gear 29 is formed as an adjusting member for the axial displacement of the hollow toothed gear 29. It has an outwardly accessible actuation part 32. The pin 31 is guided in a slot 33 in the angular transmission housing 5 and is surrounded by a bellows 34 mounted dust-tightly on the angular transmission housing 5. The pin 31 carries a not-shown clamping or holding device for fixing the turning position of the pin 31 relative to the angular transmission housing 5.

A labyrinth seal 37 is arranged between an end surface 35 of the compensating weight 14 and the end side of a collar 36 of the angular transmission 5. It prevents penetration of dust to the bearing 19 from the side of the grinding disk 6.

On the side facing away from the labyrinth seal 37, the gap between the collar 36 and the shaft 11 is sealed from the angular transmission 7 by a felt ring 38 which is fixedly mounted on the shaft 11, to prevent lubricant discharge. Moreover, a felt seal 39 seals the ring gap between the eccentric shaft 16 and the shaft 11 before the bearing 19 at the side facing toward the grinding disk 6. The felt seal 39 is formed as a disk which co-rotates with the shaft 11 and provides sealing against grinding dust.

When the eccentric disk grinder 1 is turned on by a not-shown motor with the on-off switch 4, the bevel gears 8 and 9 rotate. The bevel gear 9 rotates together with the shaft 11 and the compensating weight 14 above the rotary axis 10. The shaft 11 entrains the eccentric shaft 16 and the grinding disk 6. The grinding disk circulates about the rotary axis 10 with the eccentricity "e" and rotates due to the friction in the bearings 18 and 19 about its axis 17.

The spur gear 24, the ring disk 25 and the counter disk 26 follow the movement of the eccentric shaft 16. In the position shown in FIG. 1, the spur gear 24 disengages from the hollow toothed gear 29 and the ring disk 25 rolls with its teeth on the hollow toothed gear 29.

When the hollow toothed gear 29 with the pin 31 turns along the inclinedly extending slot 33, it displaces axially around the inclination of the slot 33. The axial displacement of the hollow toothed gear 29 causes the change of the operational steps between coarse and fine machining as follows:

When one of the two toothings 30 is coupled with the spur gear 24, then the spur gear 24 rolls on the hollow toothed gear 29 resulting in the reduction of the rotary speed of the rotating grinding disk with respect to the shaft 11 but greater than the eccentric rotary speed. Such rotation is superimposed on the eccentric movement of the tool. This position corresponds to the coarse machining step with high material removal.

When one of the toothings 30 is coupled with the ring disk 35, the ring disk can swing practically without rotation along the toothing 30 depending on the difference in the number of teeth of the toothing 30 and the ring disk 25. Therefore the ring disk 25 retains the eccentric shaft 16 in a braked condition until the torque can be neutralized due to the friction of the bearings 18,19. The grinding disk 6 can be adjusted to rotate more or less fast without the risk of high rotation, depending on the pre-tensioning of the braking device. This adjustment corresponds to the fine machining step with low material removal.

Due to the pre-tensioning by the disk springs 23,27 the above-mentioned parts are supported relative to one another with a pre-determined axial force. This leads to a pre-determined friction at the surfaces which support against one another and move relative to one another. The friction is variable and individually adjustable for customer needs.

Since the bearing friction increases with the placement of the grinding disk on the workpiece and depends on pressure applied by the operator, the grinding disk rotates when it is first placed on the workpiece.

Figure 2:
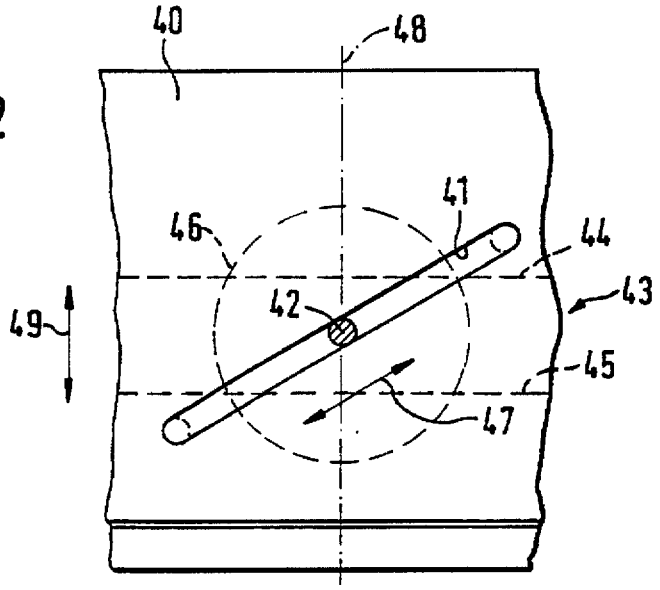
FIGS. 2–8 are sectional views showing different embodiments of adjusting elements for operational steps of the eccentric disk grinder in accordance with the present invention.

FIG. 2 shows an exemplary embodiment of the adjustment of the working steps. An inclined slot 41 is provided in the upper region of an angular transmission housing 40, substantially corresponding to the angular transmission housing 5 of FIG. 1. A pin 42 extending through the inclined slot 41 is guided in it. The pin 42 is fixedly connected with a hollow toothed gear 43 with its upper and lower edges 44 and 45 identified by dashed lines. The circle contour of a rotary knob 46 is also identified by a dashed line. The rotary knob 46 is non-releasably screwed on a not-shown thread of the pin 42.

When the pin 42 is displaced along the inclined slot 41 in accordance with the double arrow 47, the hollow toothed gear 43 follows it. It performs an axial displacement along the double arrow 49. The rotary knob 46 serves as an arresting device for the corresponding axial position of the hollow toothed gear 43 and by rotation in one or another direction is arrested or released relative to the housing 40.

Figure 3:
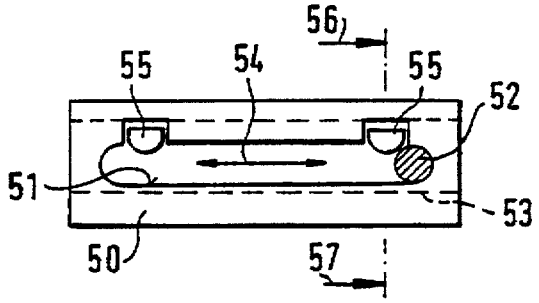

FIG. 3 shows another exemplary embodiment of the adjustment of operational steps. A straight slot 51 is provided in the angular transmission housing 50 for guiding a pin 52. A hollow toothed gear 53 is connected with the pin 52 and can turn reciprocatingly in accordance with the directional double arrow 54. Arresting springs 55 are arranged at both ends of the straight slot 51. During movement of the pin 52 in an end position they are engaged and therefore the pin 52 is fixed against the unauthorized release in each end position. With the same action, the pin can be designed elastically and pre-tensioned transversely to the displacement direction as a sheet spring, so that it can be arrested in each end position in the recesses of the straight slot 51.

Figure 4:
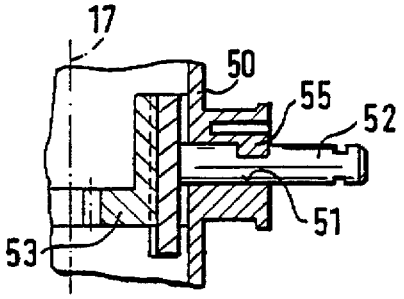

FIG. 4 which is a section of FIG. 3 along the arrows 56,57, shows the arrangement of the pin 52 in the straight slot 51 in a not-identified dove-tail-shaped guide, axially displaceable in connection with the hollow toothed gear 53. For an axial displacement of the hollow toothed gear 53, not-shown thread-like raising grooves are arranged on its outer periphery and engage in a not-shown housing projection. When the hollow toothed gear 53 is turned, it displaces axially. A reversed arrangement can be also formed by providing projections on the outer periphery of the hollow toothed gear 53, which engage in thread-like grooves of the housing.

Figure 5:
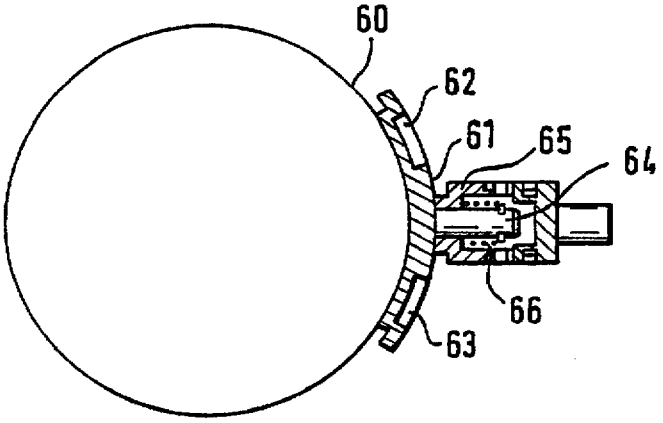

FIG. 5 shows a cross-section of an angular transmission housing 50 in which at both ends of a longitudinal slot 51 arresting holes 62,63 are provided and an axially displaceable arresting element 65 mounted on the pin 64 can engage in them. Arresting element 65 is pre-stressed by a spring 66 and form-lockingly secures the end position of the pin 64 against unauthorized release.

Figure 6:
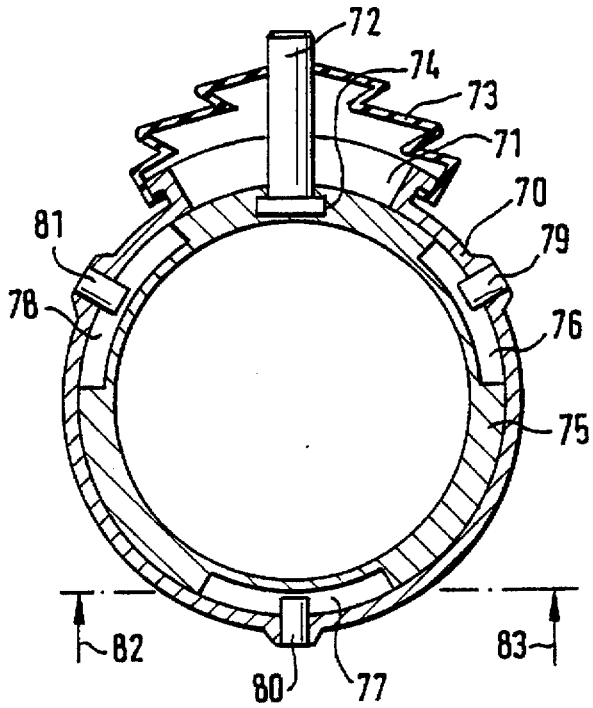
Figure 7:
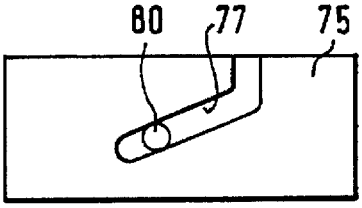

FIG. 6 shows a section of an angular transmission housing 70 with a straight slot 71 in which a pin 72 is reciprocatingly guided. The pin 72 is sealed by a bellows 73 from the angular transmission housing 70 outwardly against oil and grease discharge. The pin 72 has a T-shaped end which is displaceably guided in a T-shaped groove 74 in the outer periphery of a hollow toothed gear 75 parallel to the axis of the hollow toothed rod. The hollow toothed gear 75 is provided at its outer periphery with three inclined slots 76,77,78, and three housing projections 79,80 and 81 engaged in the slots. The arrows 82,83 show the cutting plane in FIG. 6 for the FIG. 7. In FIG. 7 a view of FIG. 6 in the direction of the arrows 82,83 is shown. Here the inclined slot 77 can be seen. It is open at an end side of the hollow toothed gear 75 and the projection 80 is guided in it.

When in the embodiments shown in FIGS. 3–7 the pin 52,64,72 reciprocatingly turns in its straight slot 51,61,71, the hollow toothed gear 53,75 guides it. Because of the thread-like inclined slot 76,77,78 the hollow toothed gear 75 performs an axial displacement when it is turned. Therefore it can displace in the sliding guide of the T-groove 74 relative to the pin 52,64,72 which is axially stationary in the straight slot 51,61,71. Because of the guidance in the straight slot 51,61,71, the pin 52,64,72 remains relative to the angular transmission housing 50,60,70 always at the same height and at the same distance from the hard of the operator so as to improve comfort.

The angle for the inclined slot 76,77,78 on the hollow toothed gear 53,75 is selected so that the torque of the motor is sufficiently high to entrain the hollow toothed gear 53,75 during the operation start of the eccentric disk grinder and to turn it in an end position in which the pin 52,64,72 is arrested. Thereby the pin 52,64,72 which by mistake is not located in an end position, does not cause damage to the toothing between the ring disk or the spur gear and the hollow toothed gear 75.

Figure 8:
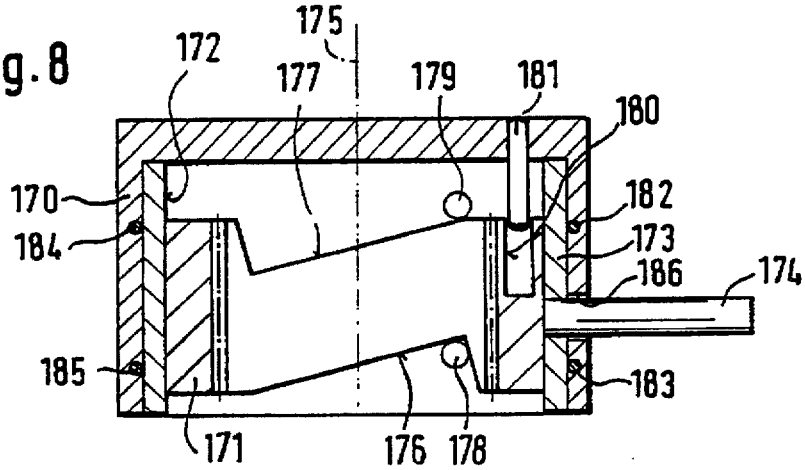

FIG. 8 shows the detail of an angular transmission housing 170 with a hollow toothed gear 171 which is axially displaceable on an inner roll 172 of a special ring 173. The ring 173 connectable with a pin 174 is axially non-displaceable due to the sealing ring 184,185 guided in the ring grooves 182,183 and is only turnable about its axis 175. The hollow toothed gear 171 has at least two end-side, ring wedge-shaped inclined surfaces 176,177 which project from pins 178,179 extending from the inner region of the ring 173. Since a pin 181 mounted on the angular transmission housing 170 is guided in an axial opening of the ring 173, the hollow toothed gear 171 cannot rotate; instead, it can only follow the sliding of the inclined surfaces 176,177 on the pins 178,179 axially to the abutment of the pin 181 at the end of the opening 180. Here the axial displacement and the turning are separate, through mutually independently movable and somewhat sealable parts, transmitted from the pin 174 to the hollow toothed gear 171 when the pin 174 is turned in the straight longitudinal slot 186.

With a small change in the embodiment of FIG. 8, a simplified variant is produced in which however the transmission of the axial displacement and the turning is released on the hollow toothed gear not via mutually independently movable parts. The ring 173 and the pin 181 are dispensed with, the pins 178,179 are connected in an unchangeable position with the angular transmission housing 170, the pin 174 is directly connected with the hollow toothed gear 171, and the slot 186 is designed as an inclined slot with the inclination of the inclined surfaces 176 and 177. The hollow toothed gear 171 during turning of the pin 174 forms during sliding of the inclined surfaces 176,177 on the pins 178,179, the substantial axial displacement for switching of the operation steps. In the not-shown embodiment it is also advantageous when the pin 174 is formed as a sheet spring mounted on an end side of the hollow toothed gear 171.

Figure 9:
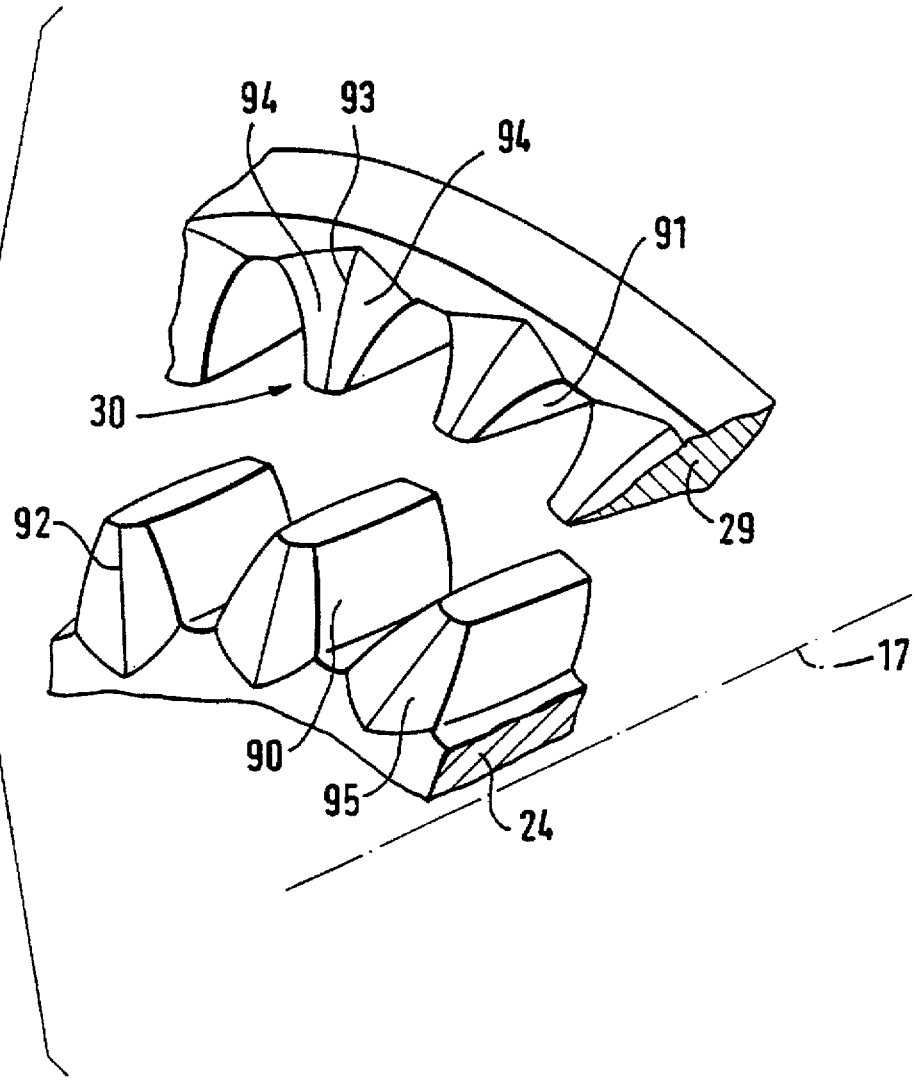
FIGS. 9 and 10 are enlarged views of transmission gears of the operational steps of the inventive eccentric disk grinder.

FIG. 9 shows an embodiment of the toothing of the ring disk or the spur gear 24 with the toothing 30 of the hollow toothed gear 29 in a section of FIG. 1. The teeth 90,91 are provided at their end side with tips 92,93, which facilitate the engagement during axial displacement or switching over from one operation step to another. Moreover, the end surfaces 94,95 of the tips 92,93 are curved as callottes. The displacement of the hollow toothed gear 29 is performed along the axis 17.

Figure 10:
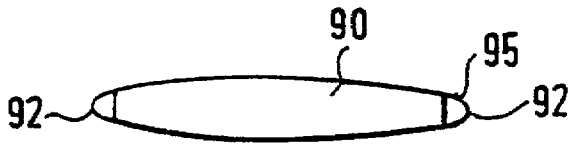

FIG. 10 shows an individual tooth 90 in accordance with FIG. 9 in a cross-section or in the plan view radially from outside. The tips 92 with the curved end sides 95 can be easily seen here. In principle all teeth of the toothed gears to be switched in the eccentric disk grinder can have the tooth cross-section shown in FIG. 10.

Since the ring disk is provided with teeth similar to the spur gear 24 and its teeth 90 can swingingly roll in the counter toothing 91 of the hollow toothed gear 29, an especially good noise condition and quiet running is provided for the ring disk.

In FIG. 11 the mounting of the compensating weight 14 of FIG. 1 on the shaft 11 of the eccentric disk grinder 1 is shown as a unit. The position of the compensating weight 14 must be secured axially and radially with respect to the shaft 11. The shaft 11 is provided at its lower free end with a ring groove 95 and an axial groove 96. The compensating weight 14 shown in section concentrically surrounds and engages with the shaft 11 on its displacement seat. A metal sheet claw 97 is mounted on the compensating weight 14 by a screw 98. A tongue 99 of the claw 97 engages in the axial groove 96, the semi-moon shaped end side 100 engages in the ring groove 95.

FIG. 12 shows a side view of the claw 97. The tongue 99, the end side 100, a drilled hole 101 and the compensating weight 14 can be seen in this Figure.

FIG. 13 shows a mounting of the compensating weight 14 on the shaft 11 as a partial view of the angular transmission housing 5 with the disk grinder 6. The claw 97 with the tongue 99, the end side 100 and the screw 98 in their position relative the shaft 11 can be easily recognized here.

The ring groove 95 and the axial groove 96 are arranged on a side of the hollow shaft 11 which is in the peripheral direction thicker and therefore mechanically stronger. The compensating weight 14 has a not-shown recess for rotation-fixed insertion of the claw 97. By pre-tensioning or clamping the claw, the compensating weight 14 can be fixed without play on the shaft 11. Thereby an especially fast and accurate mounting on the compensating weight and an easy demounting is possible.

Figure 14:
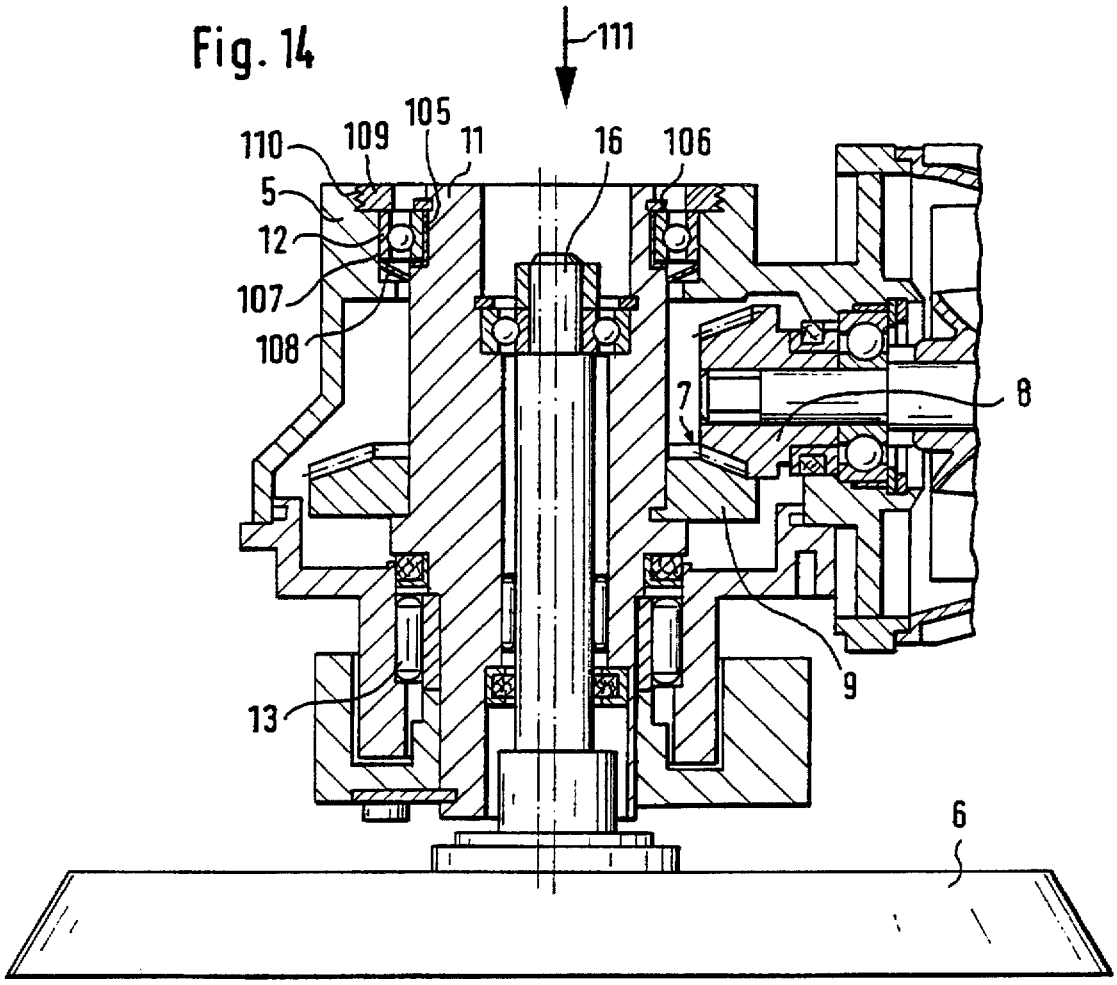
FIGS. 14 and 15 are views showing details of tooth play and adjustment of an angular transmission in the eccentric disk grinder of the embodiment of FIG. 1.

FIG. 14 shows a part of the angular transmission housing 5 of FIG. 1 with an adjusting arrangement for adjusting the tooth play or gap in the angular transmission 7. The shaft 11 carries a bevel gear 9 on its side facing the grinding disk. On its side facing away from the grinding disk 6, the shaft 11 carries on its stepped bearing seat 105 the bearing 12 with a not-shown inner ring. The bearing 12 is secured against axial displacement on the shaft 11 by a spring ring 106. The not-shown bearing outer ring of the bearing 12 is arranged in a displacement seat 107 of the angular transmission housing 5. The bearing outer Wing is supported on the side facing the grinding disk 6 against a spring ring 108. The spring ring 108 is supported on an end side of the displacement seat 107 which is formed as a stepped opening. A threaded ring 109 is screwed at the side of the bearing 12 which faces away from the grinding disk 6, in a nut thread 110 which is concentrically arranged relative to the displacement seat 107. The threaded ring 109 is supported on the outer ring of the bearing 12.

When the threaded ring 109 is axially displaced during turning in the direction of the grinding disk 6, the bearing 12 follows it and entrains in movement the shaft 11 with the bevel gear 9 and with the eccentric shaft 16 as well as the grinding disk 6. Thereby the distance between the bevel gear 9 and the smaller bevel gear 8 is increased.

Reversely, for increasing the gap between the bevel gears 8 and 9, the threaded ring 109 must be screwed out so that the shaft 11 moves to the side of the angular transmission housing 5 which faces away from the grinding disk 6 under the spring force of the spring ring 108. Therefore the bearing 13 assumes the axial displacement of the shaft 11. The arrow 111 identifies an observation direction on the section plane for FIG. 15.

Figure 15:
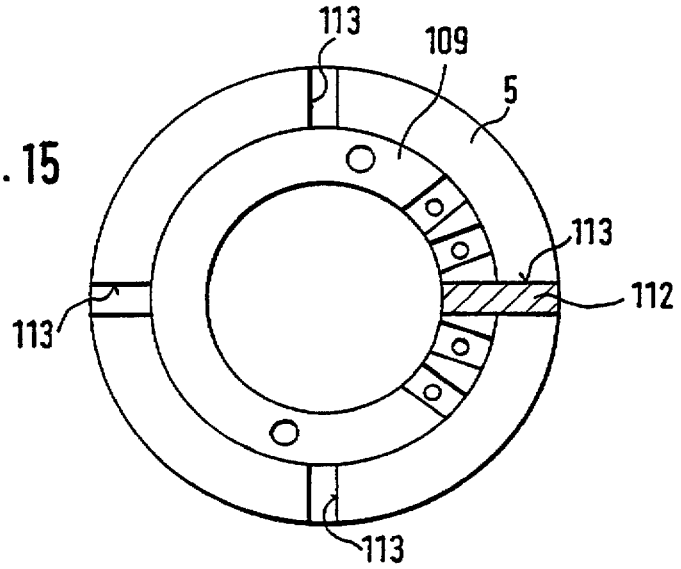

FIG. 15 shows a plan view of the arrangement of FIG. 14 in the direction of the arrow 111. Here, the angular transmission housing 5 and the threaded ring 109 can be easily seen. The tongue 112 of the threaded ring 109 can engage in one of four recesses 113 of the angular transmission housing 5 and prevent a rotation of the threaded ring 109.

For preventing rotation of the threaded ring, instead of the tongue 112, also synthetic plastic or metal clips or other clamp-like spring elements can be used. They can be arranged engageably into tooth-shaped recesses on the end side of the threaded ring 109 and the radially adjacent region of the housing 5. Similarly, a selected turning position of the threaded ring 109 can be secured by axial openings on the outer edge of the threaded ring and the axially adjacent region of the angular transmission housing 5 in cooperation with pin-like engaging elements insertable in the openings.

The tooth gap can be simply adjusted in the embodiment of FIG. 14 by turning the outwardly located threaded ring. For this purpose the dismounting of the grease filled transmission region is not needed.

When the eccentric disk grinder operates, pressure is applied on the workpiece by the grinding disk 6. The shaft 11 is supported by the bearing 12 and by the thread flanks of the threaded ring 109 in a gap-free manner. Opposite forces resulting from the weight, the starting moment of the machine and centrifugal forces are taken up by the spring ring 108, and the tooth gap can be automatically increased over the short time when needed.

In accordance with a not-shown embodiment of the invention, instead of the spur gears, only a single toothed ring disk can be arranged at a loose gear on the eccentric shaft and roll on a hollow toothed gear connected with the housing. The ring disk can be fixed by actuation from outside with available braking force to a complete stop relative to the eccentric shaft. Moreover, the ring disk can be displaced axially from outside and thereby disengaged from the hollow toothed gear.

In accordance with a further not-shown embodiment of the eccentric disk grinder, the ring disk without rolling on a housing region can be fixed by an elastic spring member, for example by an elastic band or a spring, on the housing. Thereby the ring disk follows the eccentric swinging of the eccentric shaft without rotation and transmits friction force to the eccentric shaft.

In accordance with a further not-shown embodiment of the eccentric disk grinder, the pin can be pre-stressed in a sheet spring-like manner for axial displacement of the hollow toothed gear. It can be arrested in a springy manner in recesses at the end of the inclined slots.

In accordance with a further not-shown embodiment of the invention, the hollow toothed gear can be axially displaceable so that it does not engage the ring disk. Here the "high rotation brake" is not subjected to an outer force. In this position the grinding disk can be rotated to the rotary speed of the shaft when it is lifted from the workpiece. However, in this position a further working step is provided between the coarse and fine working steps and has a lower material removal, since through the grinding disk only lower torque can be transmitted to a workpiece in correspondence with the friction in the bearings.

In the last-mentioned not-shown embodiment the braking device is arranged on a sleeve which is fixed on the eccentric shaft for joint rotation. Therefore the braking device can be premounted and preadjusted in an especially simple manner.

It is to be understood that in the described embodiments the braking ring disk can be supported loosely or fixedly on the eccentric shaft for example via a roller bearing at the end side on a counter surface which is fixed to the housing or arranged movably on the housing.

It is also to be understood that in the preceding embodiments a ring disk can extend in a pin which is fixed in the housing by providing a longitudinal hole in it, so as to allow the swinging of the ring disk. The pin-elongated hole connection can be designed in an especially friction and noise-free manner by means of a needle sleeve and/or a damping sleeve arranged on the pin. When the ring disk and the hollow toothed gear are provided with magnetic friction or rolling surfaces, the above-described solutions are further improved.

A further improvement resides in that, by changing the axial pre-stress between the ring disk and the counter surfaces, the braking action of the ring disk is neutralized when needed. The eccentric shaft is arranged displaceably with an axial gap together with the grinding disk and the braking action of the ring disk is controllable by the displacement position. In this manner when the grinding disk is lifted from the workpiece the brake is activated, and when the grinding disk is placed on the workpiece the brake is turned off.

The embodiments of the invention can be naturally adapted and transferred to the eccentric disk grinder with or without the angular transmission.

Also, the inventive eccentric disk grinder can be used in other machine tools, in particular hand drilling machines, known adjusting mechanisms for switching over the operation steps, in which by means of an eccentric on the end of a rotatable pin the axial displacement of the switching toothed gear is activated, analogous to the switching shaft in motor vehicle transmissions or conventional key-lock systems with bars or as in door handles.

It will be understood that each of the elements described above, or two or more together, may also find a useful application in other types of constructions differing from the types described above.

While the invention has been illustrated and described as embodied in an eccentric disk grinder with a grinding disk brake, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An eccentric disk grinder, comprising a rotatable grinding disk; an eccentric shaft fixedly connected with said grinding disk; a further shaft having an axis and an eccentric axial opening in which said eccentric shaft is arranged rotatably relative to said further shaft; a motor rotating said further shaft and therefore moving said eccentric shaft eccentrically, circulatingly and rotatably around said axis of said further shaft; a braking device for delaying a rotary movement of said grinding disk, said braking device having a rotatable braking element which delays the rotary movement of said grinding disk by being delayable relative to said grinding disk; said braking device also having a hollow gear, said braking element being adjustably delayable relative to staid grinding disk and also rolling on said hollow gear.

2. An eccentric disk grinder as defined in claim 1, and further comprising a motor housing accommodating said motor.

3. An eccentric disk grinder as defined in claim 1, wherein said braking element is formed as a disk.

4. An eccentric disk grinder as defined in claim 1, wherein said braking element follows only the circulatory movement of said eccentric shaft and does not follow its rotation.

5. An eccentric disk grinder as defined in claim 1; and further comprising an additional part, said braking element being elastically supported on said additional part.

6. An eccentric disk grinder as defined in claim 5, wherein said additional part is a motor housing which accommodates said motor.

7. An eccentric disk grinder as defined in claim 5; and further comprising an angular transmission and an angular transmission housing accommodating said angular transmission and forming said additional part.

8. An eccentric disk grinder as defined in claim 1, wherein said braking element rolls on an additional part so that said braking element is subjected to a rotation opposite to said circulatory movement of said grinding disk.

9. An eccentric disk grinder as defined in claim 1, wherein said braking element is formed as a ring disk which is concentrically arranged on said eccentric shaft and is supported on at least one counter disk arranged on said eccentric shaft.

10. An eccentric disk grinder as defined in claim 9, wherein said braking element is rotatable on said eccentric shaft while said counter disk is fixed on said eccentric shaft.

11. An eccentric disk grinder as defined in claim 10, wherein said braking element and said counter disk are arranged axially displaceably on said eccentric shaft; and further comprising means for axially holding said braking element and said counter disk relative to one another said axially holding means including spring means.

12. An eccentric disk grinder as defined in claim 1, wherein said further shaft is formed as a hollow shaft which is open at its both ends so that said eccentric shaft is arranged in said shaft and extends outwardly beyond said both ends.

13. An eccentric disk grinder as defined in claim 12, wherein said braking element of said braking device is formed as a disk.

14. An eccentric disk grinder as defined in claim 12; and further comprising an angular transmission through which said grinding disk is driven; and an angular transmission housing accommodating said angular transmission.

15. An eccentric disk grinder as defined in claim 14, wherein said braking device is arranged in said angular transmission housing on a side of said angular transmission which faces away from said grinding disk on said eccentric shaft.

16. An eccentric disk grinder as defined in claim 14, wherein said braking element is disengageable from said angular transmission housing so that said braking element cannot roll on said angular transmission housing in a disengaged position.

17. An eccentric disk grinder as defined in claim 14, wherein said angular transmission housing has a region coupled to it upon which region said braking element rolls and which is formed as a hollow toothed gear.

18. An eccentric disk grinder as defined in claim 17, wherein said braking element is adjustably delayable by axially displacing said hollow toothed gear.

19. An eccentric disk grinder as defined in claim 17, wherein said braking element is formed as a spur gear with a number of teeth corresponding to a number of teeth of said hollow toothed gear.

20. An eccentric disk grinder as defined in claim 17, wherein said braking element has a number of teeth which is different by at least one tooth from a number of teeth of said hollow toothed gear.

21. An eccentric disk grinder as defined in claim 17, wherein said hollow toothed gear has teeth, said braking element having tips, at least one of said teeth and tips having curved surfaces.

22. An eccentric disk grinder as defined in claim 21, wherein said surfaces are spherical.

23. An eccentric disk grinder as defined in claim 17, wherein a part of said braking device is formed as a spur gear which is couplable with said hollow toothed gear and fixed on said eccentric shaft, said spur gear having a number of teeth smaller than a number of teeth of said hollow toothed gear and teeth of said spur gear having end-side tips with curved surfaces.

24. An eccentric disk grinder as defined in claim 23, wherein said curved surfaces are spherical.

25. An eccentric disk grinder as defined in claim 17; and further comprising guiding means through which said hollow toothed gear is coupled with said angular transmission housing; and actuating means displacing said hollow toothed gear.

26. An eccentric disk grinder as defined in claim 25, wherein said guiding means is formed as at least one slot provided in said angular transmission housing, said actuating means being formed as a pin which extends through said slot and is displaceable along said slot together with said hollow toothed gear.

27. An eccentric disk grinder as defined in claim 26, wherein said guiding means is formed as a ring wedge-shaped inclined surface which extends inclinedly relative to an axis of said eccentric shaft.

28. An eccentric disk grinder as defined in claim 27, wherein said inclined surface is formed as a slot.

29. An eccentric disk grinder as defined in claim 25, wherein said guiding means is formed as an inclined surface which is provided on said hollow toothed gear and is displaceably guided on a guiding element.

30. An eccentric disk grinder as defined in claim 29, wherein said inclined surface is provided on a periphery of said hollow toothed gear.

31. An eccentric disk grinder as defined in claim 29, wherein said inclined surface is provided on an axial end side of said hollow toothed gear.

32. An eccentric disk grinder as defined in claim 29, wherein said guiding element is formed as a pin.

33. An eccentric disk grinder as defined in claim 17; and further comprising a pin which is displaceably guided on said hollow toothed gear parallel to an axis of said eccentric shaft.

34. An eccentric disk grinder as defined in claim 33, wherein said pin is elastically bendable perpendicular to a displacement direction as a sheet-spring.

35. An eccentric disk grinder as defined in claim 34, wherein said pin is pre-stressed.

36. An eccentric disk grinder as defined in claim 33; and further comprising a ring which is rotatable only about its axis and is axially non-displaceable and has an inner region, said pin being mounted on said ring, said hollow toothed gear being located in said inner region and having on an end-side a ring wedge-shaped inclined surface which is guided so that an axial displacement and rotation are performed through separate and independent parts which are easy to seal from each other.

37. An eccentric disk grinder as defined in claim 36; and further comprising a lug extending in said inner region and guiding said inclined surface.

38. An eccentric disk grinder as defined in claim 36; and further comprising an elastic sleeve which surrounds said pin so as to seal the latter.

39. An eccentric disk grinder as defined in claim 38, wherein said elastic sleeve is formed as a bellows.

40. An eccentric disk grinder as defined in claim 1, wherein said further shaft has a groove; and further comprising a compensating weight which is supported on said further shaft and has a claw engaging in said groove in a form-locking and force-transmitting manner.

41. An eccentric disk grinder as defined in claim 40, wherein said further shaft has an outer wall provided with a ring groove and an axial groove intersecting one another.

42. An eccentric disk grinder as defined in claim 40, wherein said further shaft is formed as a hollow shaft.

43. An eccentric disk grinder as defined in claim 1; and further comprising an angular transmission provided between said motor and said shaft; an angular transmission housing accommodating said angular transmission; a bearing arranged in said angular transmission housing at a side facing away from said grinding disk and displaceable against a spring force together with said shaft.

44. An eccentric disk grinder as defined in claim 43, wherein said angular transmission has a bevel gear, said bearing being axially displaceable together with said bevel gear.

45. An eccentric disk grinder as defined in claim 43; and further comprising an adjusting element arranged in said angular transmission housing for displacing said bearing together with said shaft.

46. An eccentric disk grinder as defined in claim 45, wherein said adjusting element is formed as a screw element.

47. An eccentric disk grinder as defined in claim 45, wherein said bearing has an outer ring which is displaceable by said adjusting element.

48. An eccentric disk grinder as defined in claim 45, wherein said angular transmission housing has an inner thread, said adjusting element being formed as a threaded ring which is screwed in said inner thread of said angular transmission housing and supported on one end side of said bearing; and further comprising a spring ring against which another side of said bearing is supported.

49. An eccentric disk grinder as defined in claim 48, wherein said threaded ring is arrestable in at least one rotary position from turning relative to said angular transmission housing; and further comprising arresting means for arresting said threaded ring in at least one rotary position.

50. An eccentric disk grinder as defined in claim 49, wherein said arresting means includes arresting openings and arresting projections which engage in said arresting openings.

51. An eccentric disk grinder as defined in claim 45, wherein said bearing has an outer ring with one side supported on said threaded ring and another side supported on said spring ring.

* * * * *